US010480793B2

(12) United States Patent
Widmer

(10) Patent No.: US 10,480,793 B2
(45) Date of Patent: Nov. 19, 2019

(54) COMBINATION OUTDOOR FIREPLACE AND PIZZA OVEN

(71) Applicant: Round Grove Products, LLC, Apple Creek, OH (US)

(72) Inventor: Scott Widmer, Dalton, OH (US)

(73) Assignee: ROUND GROVE PRODUCTS, LLC, Apple Creek, OH (US)

( * ) Notice: Subject to any disclaimer, the term of this patent is extended or adjusted under 35 U.S.C. 154(b) by 136 days.

(21) Appl. No.: 15/796,949

(22) Filed: Oct. 30, 2017

(65) Prior Publication Data

US 2018/0142895 A1 May 24, 2018

Related U.S. Application Data

(60) Provisional application No. 62/424,581, filed on Nov. 21, 2016.

(51) Int. Cl.

| | |
|---|---|
| ***A21B 1/00*** | (2006.01) |
| ***F24B 1/28*** | (2006.01) |
| ***F24B 1/182*** | (2006.01) |
| ***F24B 1/189*** | (2006.01) |

(52) U.S. Cl.
CPC ..... *F24B 1/182* (2013.01); *F24B 1/189* (2013.01)

(58) Field of Classification Search
CPC ..... F24B 1/00; F24B 1/28; F24B 3/00; F24B 7/00; A21B 1/00
See application file for complete search history.

(56) References Cited

U.S. PATENT DOCUMENTS

| | | | | | |
|---|---|---|---|---|---|
| 1,451,246 | A * | 4/1923 | Wetzel | F24B 1/182 | 126/506 |
| 3,169,516 | A * | 2/1965 | Agnese | A47J 37/06 | 126/111 |
| 3,805,762 | A * | 4/1974 | Nelson | F24C 3/00 | 126/506 |
| 4,062,344 | A * | 12/1977 | Mayes | F24B 1/18 | 126/509 |
| 4,159,016 | A * | 6/1979 | Johnson | F24B 1/26 | 126/506 |
| 4,253,444 | A * | 3/1981 | Johnson | F24B 1/1802 | 126/506 |
| 4,850,332 | A * | 7/1989 | Sivonen | A21B 1/04 | 126/8 |
| 5,347,977 | A * | 9/1994 | Lehikoinen | F24B 1/04 | 126/1 D |
| 5,492,055 | A * | 2/1996 | Nevin | A21B 1/26 | 99/331 |
| 2007/0221191 | A1* | 9/2007 | O'Brien | A47J 37/0713 | 126/25 R |

* cited by examiner

*Primary Examiner* — Gregory A Wilson
(74) *Attorney, Agent, or Firm* — Jacob M. Ward; Ward Law Office LLC

(57) ABSTRACT

A combination outdoor fireplace and pizza oven system includes a main body with a framework assembly. The framework assembly has a fireplace firebox, an oven firebox, a smokebox, and a chimney flue disposed therein. Each of the fireplace firebox and the oven firebox is in communication with the smokebox. The smokebox is in communication with the chimney flue. The framework assembly is covered by a refractory heat resistant mortar. The oven firebox is suspended above the fireplace firebox and is configured for baking pizza. The smokebox and the chimney flue are disposed in the framework assembly above both the fireplace firebox and the oven firebox.

16 Claims, 6 Drawing Sheets

COMBINATION OUTDOOR FIREPLACE AND PIZZA OVEN

CROSS-REFERENCE TO RELATED APPLICATIONS

This application claims the benefit of U.S. Provisional Application No. 62/424,581, filed on Nov. 21, 2016. The entire disclosure of the above application is hereby incorporated herein by reference.

FIELD

The present disclosure relates to outdoor fireplaces and, in particular, an outdoor fireplace having an oven for baking edible goods such as pizza.

BACKGROUND

Outdoor fireplaces have become increasingly popular, either as a landscape feature or as part of an outdoor kitchen. However, construction of an outdoor fireplace has been labor intensive and consequently expensive. Typical outdoor fireplaces are constructed from brick, block or stone components which are custom built for each installation. In some cases, few of the fireplace components have been constructed at a manufacturing facility, while brick or stone veneer is manually applied at the jobsite.

Outdoor pizza ovens that use solid fuel (e.g. wood, charcoal, pellets, charcoal briquettes, and coal) are also increasingly popular. However, these outdoor pizza ovens often fail to provide adequate, or proper, and consistent cooking temperatures. Classically-styled brick ovens are also often large, heavy, and built-in fixtures, for example, assembled by a skilled craftsman in an end-users' backyard.

There is a continuing need for an outdoor fireplace that also facilitates the baking of pizzas. Desirably, the combination outdoor fireplace and pizza oven is constructed at a manufacturing facility offsite, and is easily transportable to a final location for end use.

SUMMARY

In concordance with the instant disclosure, an outdoor fireplace that also facilitates the baking of pizzas, and which is constructed at a manufacturing facility offsite, and is easily transportable to a final location for end use, is surprisingly discovered.

In one embodiment, a combination outdoor fireplace and pizza oven system includes a main body with a framework assembly. The framework assembly has a fireplace firebox, an oven firebox, a smokebox, and a chimney flue disposed therein. Each of the fireplace firebox and the oven firebox is in communication with the smokebox. The smokebox is in communication with the chimney flue. The framework assembly is further covered by a refractory heat resistant mortar. The oven firebox is suspended above the fireplace firebox and configured for baking pizza. The smokebox and the chimney flue are disposed in the framework assembly above both the fireplace firebox and the oven firebox.

In another embodiment, the fireplace firebox is in communication with the smokebox via a first flue duct and a second flue duct. The first flue duct is disposed between the oven firebox and a first sidewall of the main body. The second flue duct is disposed between the oven firebox and a second sidewall of the main body. In operation, the smoke and hot gases from the fireplace firebox will flow around the oven firebox to the smokebox and out through the chimney flue.

In a further embodiment, the fireplace firebox is in communication with the smokebox via a single flue duct. The single flue duct is disposed between the oven firebox and a rear wall of the main body. In operation, the smoke and hot gases from the fireplace firebox will flow behind the oven firebox to the smokebox and out through the chimney flue.

In an exemplary embodiment, the combination outdoor fireplace and pizza oven system is constructed using structural panels of 2½" wide 18" gage galvanized U-channels made of top and bottom members that interlock with 2⅜" 18 gage galvanized wide U-channels upright framing members. Each union of the vertical uprights and horizontal top/bottom members is fastened with two screws. Then individual panels are fastened together to create the box-frame assembly of the product, or the skeletal framework. A skilled artisan may also select other materials and dimensions within the scope of the disclosure, as desired.

The system comprises a structural framing for lifting and positioning the unit, a fireplace firebox, a pizza oven firebox, a smokebox, and a chimney flue, all of which are contained within the skeletal framework assembly. The pizza oven is suspended above the fireplace firebox. Variations of this configuration permit the pizza oven and the fireplace to function either dependently or independently from each other. The distinction between the two variations is the combustion source.

In the dependent variation, there is no brick dome over the pizza oven, so it functions as a cooking area rather than as a firebox. A fire in the fireplace firebox below heats the pizza oven cooking area above. In this configuration, the pizza oven cooking area can be either: enclosed and indirectly heated by the combustion source below—acting more like a convection oven; or open to the smoke and heat directly from the combustion source—acting more like a smoker.

In the independent variation, the pizza oven firebox is insulated from the fireplace firebox—smoke and hot gasses from the fireplace firebox pass around the outside of the insulated pizza oven firebox and proceed into the smokebox. Both fireboxes can function simultaneously and independently of each other. A fire in the pizza oven firebox will only heat that specific space and, vice versa, a fire in the fireplace firebox will only heat that specific space.

The structural framing for lifting and positioning the unit includes a full-depth panel of U-channel members attached to box-iron channels. The box-iron channels allow access for forklifts, slings, or straps for lifting and positioning the unit. The exposed framing also allows access for anchoring the unit to the foundation slab.

The smokebox collects all the smoke and hot gasses from both fireboxes and reduces the airspace cross-section to a choke-point transitioning into the chimney flue. The chimney flue allows the smoke and hot gasses to exit the system. The geometry of the smokebox and chimney flue aids in the "draw" of the unit, creating high pressure above the choke-point relative to the low pressure within the firebox, to draw the smoke and hot gasses through the unit and to partially overcome any negative pressure at the firebox opening from cross-winds.

It should be understood that the present disclosure includes a combination of the fireplace and pizza oven and the dependent and independent variations of the combustion source. An additional useful feature is the combination of these features along with the structural framing for lifting and positioning the unit.

BRIEF DESCRIPTION OF THE DRAWINGS

The drawings described herein are for illustrative purposes only of selected embodiments and not all possible implementations, and are not intended to limit the scope of the present disclosure. The above, as well as other advantages of the present disclosure, will become readily apparent to those skilled in the art from the following detailed description, particularly when considered in the light of the photographs and drawings described hereafter.

DETAILED DESCRIPTION

Figure 1:
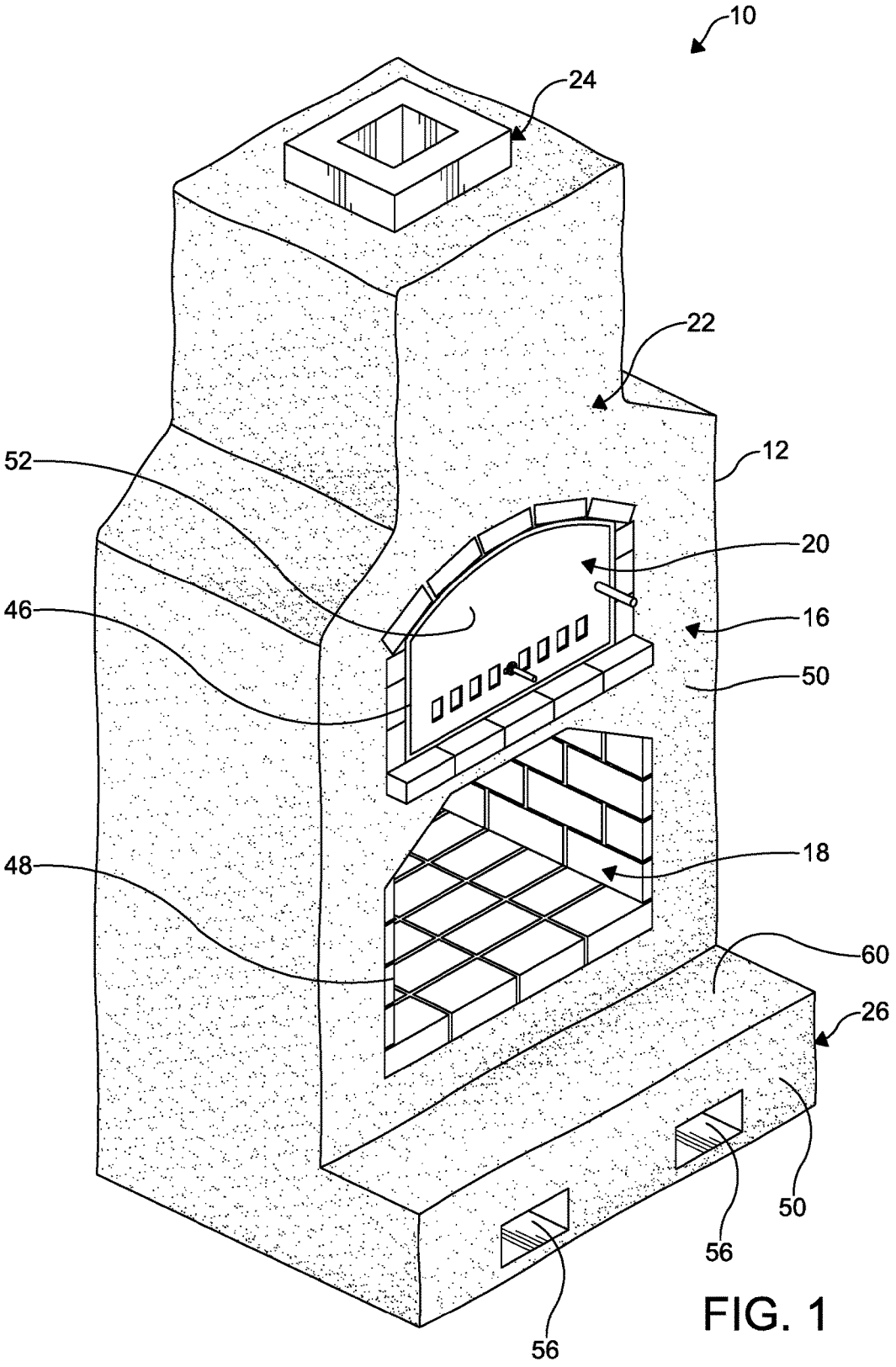
FIG. 1 is a top perspective view of a combination outdoor fireplace and pizza oven system according to one embodiment of the disclosure.
Figure 2:
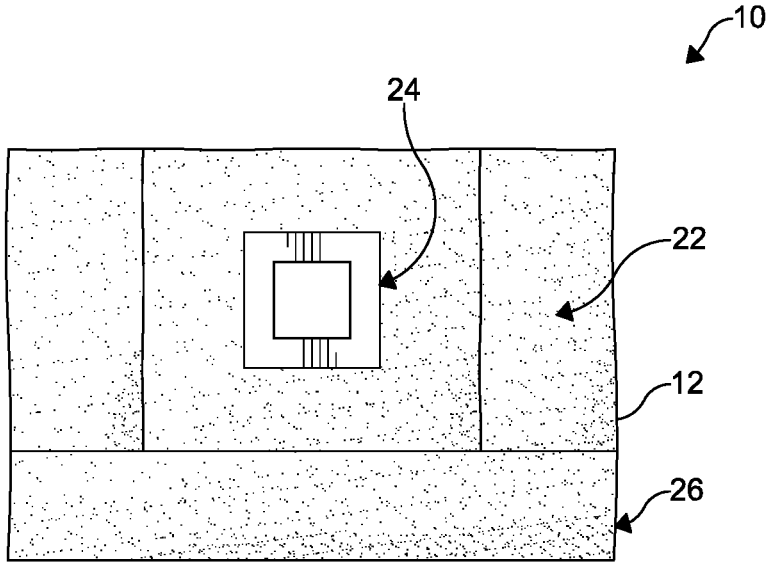
FIG. 2 is a top plan view of the combination fireplace and pizza oven system shown in FIG. 1.
Figure 3:
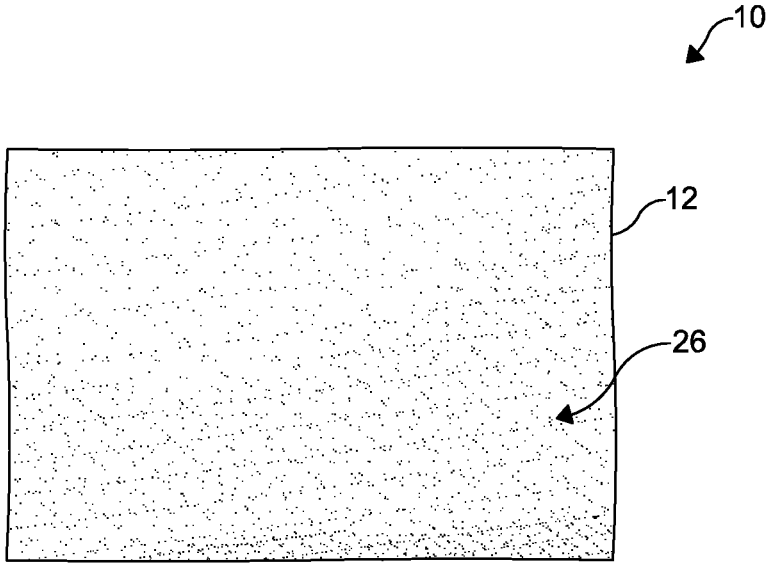
FIG. 3 is a bottom plan view of the combination fireplace and pizza oven system shown in FIG. 1.
Figure 5:
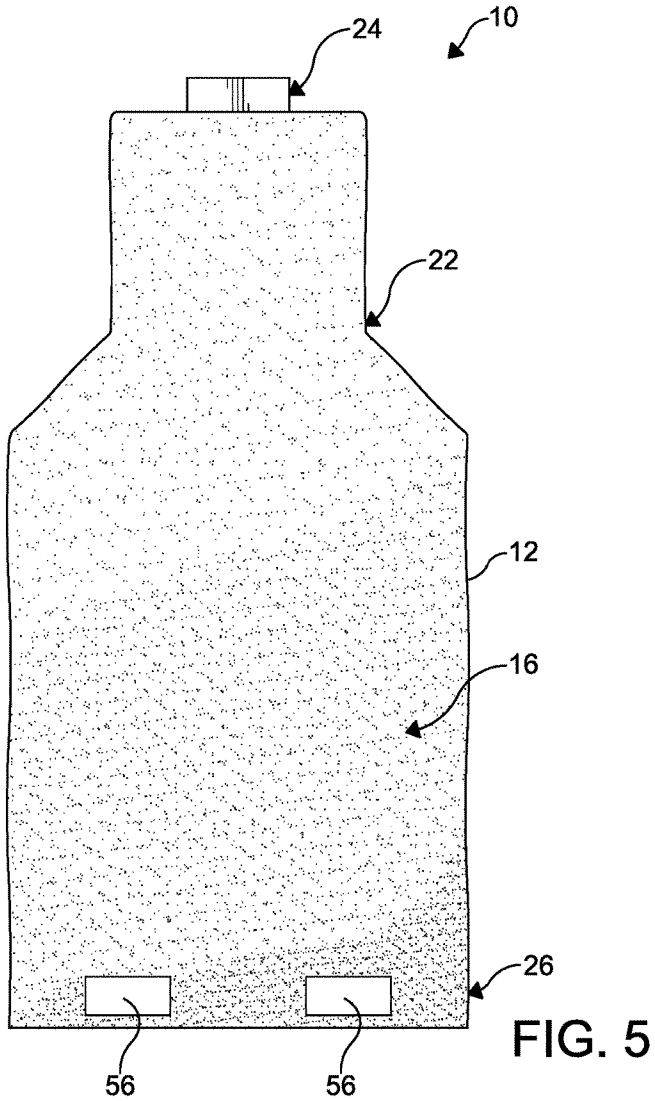
FIG. 5 is a rear elevational view of the combination fireplace and pizza oven system shown in FIG. 1.
Figure 4:
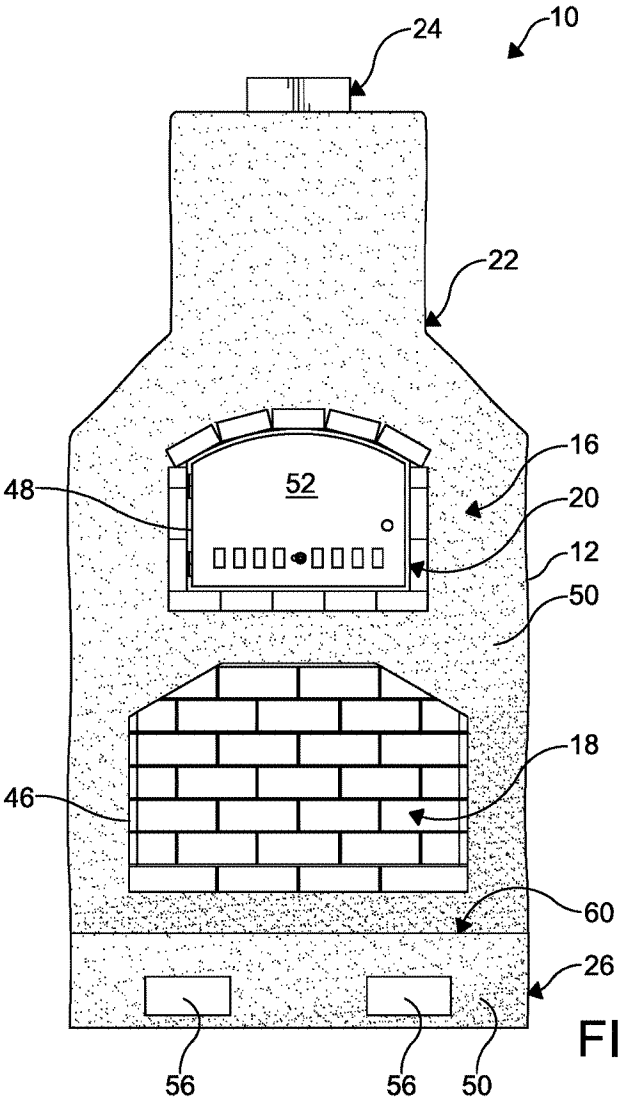
FIG. 4 is a front elevational view of the combination fireplace and pizza oven system shown in FIG. 1.

The following description is merely exemplary in nature and is not intended to limit the present disclosure, application, or uses. It should be understood that throughout the drawings, corresponding reference numerals also indicate like or corresponding parts and features. In respect of the methods disclosed, the order of the steps presented is exemplary in nature, and thus, is not necessary or critical unless otherwise disclosed.

Figure 7:
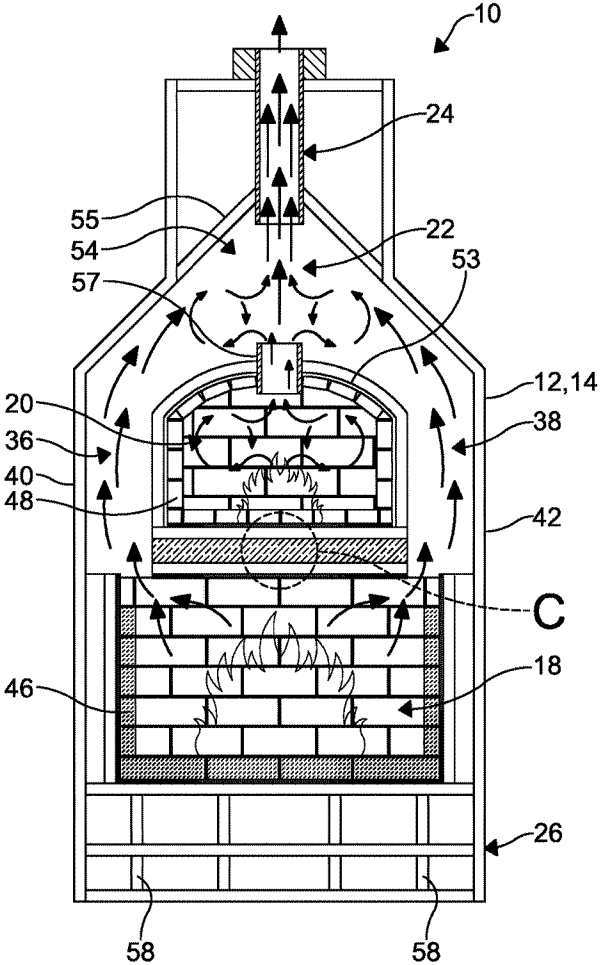
FIG. 7 is a cross-sectional elevational depiction of the interior of the combination fireplace and pizza oven system taken at section line A in FIG. 6, and further depicting an airflow through the system in operation with the flues shown on both sides of the pizza oven.
Figure 6:
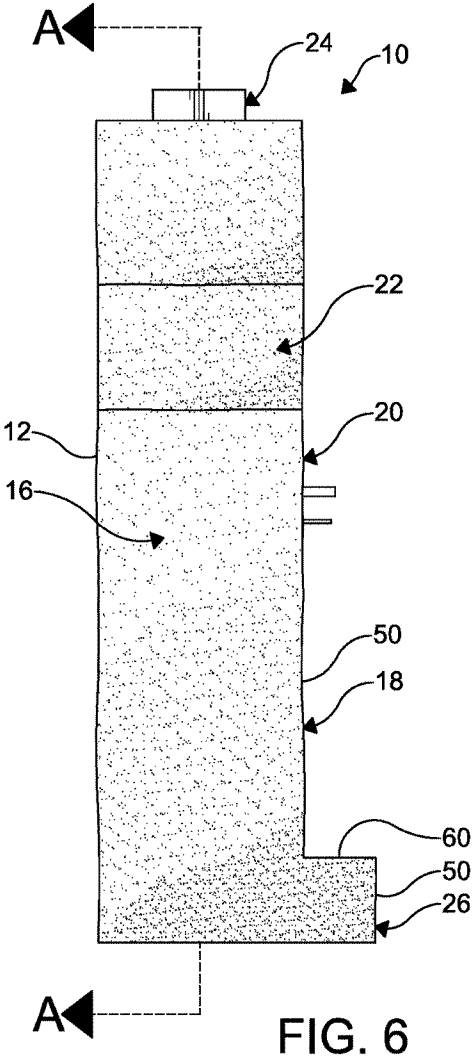
FIG. 6 is a right side elevational view of the combination fireplace and pizza oven system shown in FIG. 1.
Figure 9:
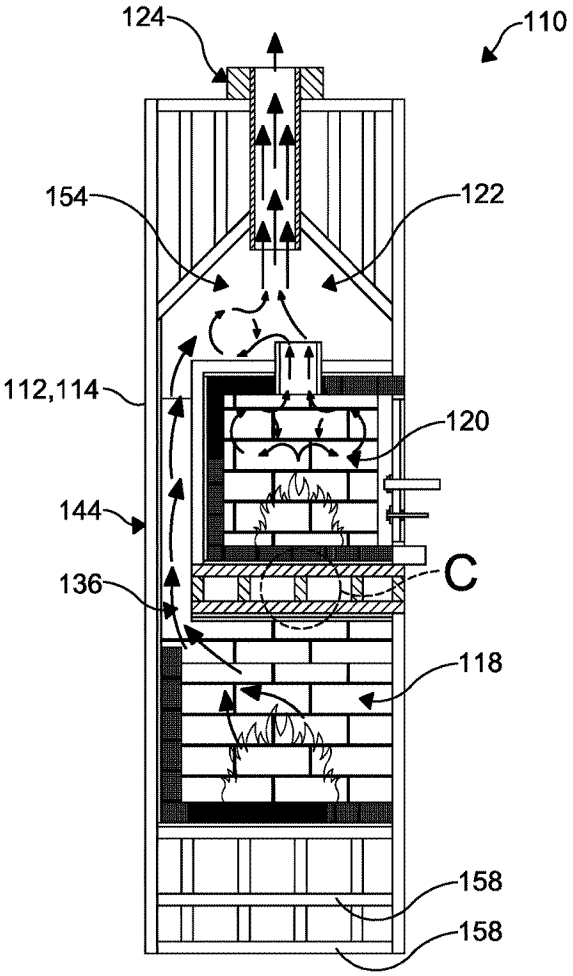
FIG. 9 is a cross-sectional elevational side view of the interior of the combination fireplace and pizza oven system taken at section line B in FIG. 8, and further depicting an airflow through the system in operation with a single flue shown on behind the pizza oven.
Figure 8:
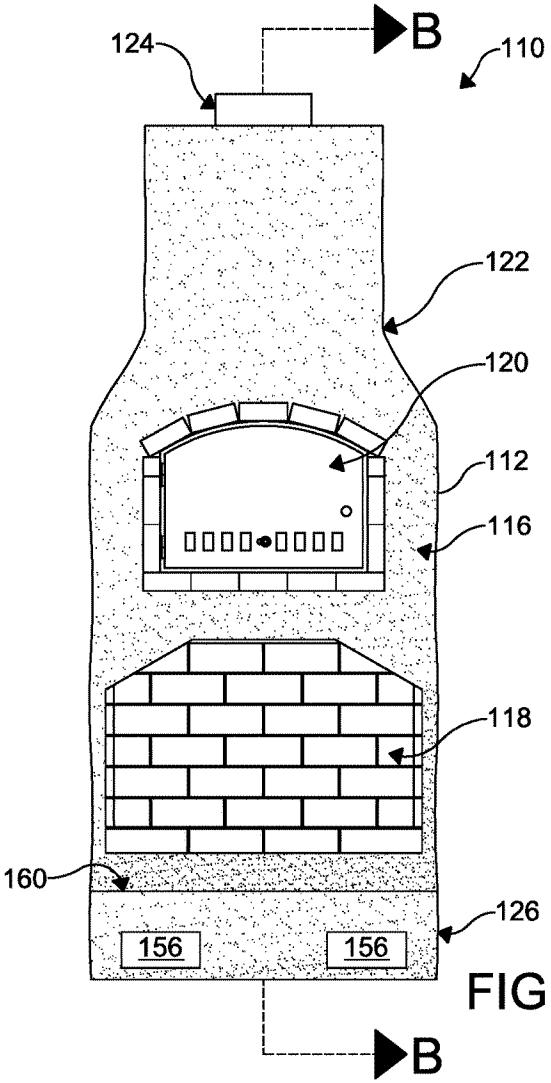
FIG. 8 is front elevational view of a combination fireplace and pizza oven system according to another embodiment of the disclosure.
Figure 10:
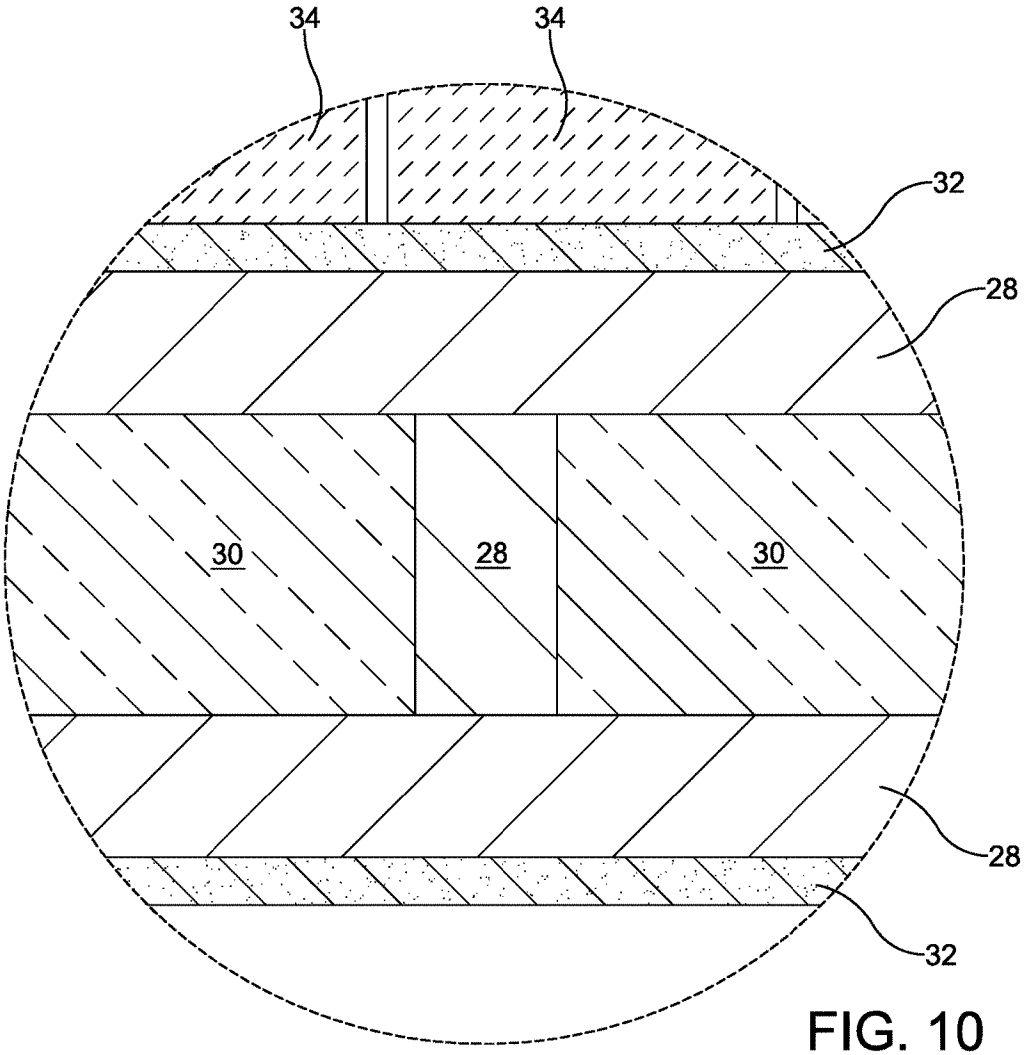
FIG. 10 is an enlarged fragmentary cross-section elevational side view of the interior of the combination fireplace and pizza oven system taken at callout C in FIGS. 7 and 9.

In FIGS. 1-10, a combination fireplace and pizza oven system 10, 110 according to various embodiments of the disclosure is shown. In FIGS. 1-7 and 10, a side-flue embodiment of the combination fireplace and pizza oven system 10 is illustrated. In FIGS. 8-10, a rear-flue embodiment of the combination fireplace and pizza oven system 110 is illustrated. One of ordinary skill in the art may also select alternate suitable flue arrangements for the combination fireplace and pizza oven system 10, 110, as desired.

In FIGS. 1-7, the system 10 includes a main body 12 defined by a framework assembly 14 (shown in FIG. 7) covered by a refractory heat resistant mortar 16, and containing a fireplace firebox 18, an oven firebox 20, a smokebox 22, a chimney flue 24, and a base 26. In particular, the framework assembly 14 includes a framework of steel channel members, as described further hereinbelow. The steel channel members define chambers for the fireplace firebox 18 and the oven firebox 20 within the framework assembly 14.

In certain examples, the framework assembly 14 is formed from galvanized steel channel stock. Galvanized steel channel stock has been found to be particularly suitable for the system 12, especially compared to aluminum stock, which will warp or melt, or common masonry, which will fracture or crack, at the temperatures and heat cycles associated with operation of conventional fireplaces and pizza ovens. In other examples, the refractory heat resistant mortar may be formed from a mixture of fireclay, cement, and sand, to provide a mortar that is both visually appealing and resistant to the temperatures associated with operation of conventional fireplaces and pizza ovens. One of ordinary skill in the art may select alternative suitable materials for the framework assembly 14 and the refractory heat resistant mortar 16 within the scope of the present disclosure.

As shown in FIG. 7, the oven firebox 20 may be suspended above the fireplace firebox 18. The fireplace firebox is configured for burning wood and other suitable fireplace media. The oven firebox 20 is configured for burning wood and other suitable fireplace media, and also for baking edible goods, such as pizza. Each of the fireplace firebox 18 and the oven firebox 20 are formed from noncombustible or refractory materials. In one nonlimiting example, each of the fireplace firebox 18 and the oven firebox 20 are formed from noncombustible magnesium oxide board and refractory bricks. One of ordinary skill in the art may select other suitable refractory materials for the fireplace firebox 18 and the oven firebox 20, as desired.

In a particular embodiment shown in FIG. 10, the fireplace firebox 18 and the oven firebox 20 are thermally insulated from one another. For example, the fireplace firebox 18 and the oven firebox may be separated by an insulating arrangement of steel channel members 28, insulation 30 such as mineral wool insulation, and a noncombustible board 32 such as magnesium oxide board. The insulation 30 may be disposed within a hollow portion of the steel channel members 28, between the noncombustible board 32 of the fireplace firebox 18 and the noncombustible board 32 of the oven firebox 20, for example. The noncombustible board 32 may further be secured to the steel channel members 28 with fasteners such as screws, bolts, rivets, or the like. Refractory bricks 34 may be laid atop the noncombustible board 32 to form a floor of the oven firebox 20. The noncombustible board 32 may be left uncovered and form a ceiling of the fireplace firebox 18. In this manner, heat transfer between the fireplace and oven fireboxes 18, 20 is minimized during an operation of the system 10. Other suitable insulating means are also contemplated and considered within the scope of the present disclosure.

Although the insulative layered construction is specifically shown in FIG. 10 at the top of the fireplace firebox 18 and the base of the oven firebox 20, it should be appreciated that the layered construction shown may also be used for the various other sides and tops of the respective fireboxes 18, 20, as desired.

With renewed reference to FIG. 7, the smokebox 22 and the chimney flue 24 are disposed in the framework assembly 14 above both the fireplace firebox 18 and the oven firebox 20. The fireplace firebox 18 is in communication with smokebox 22 through at least one flue duct 36, 38. The at least one flue duct 36, 38 may include a first flue duct 36 and a second flue duct 38. The first flue duct 36 may be disposed between the oven firebox 20 and a first sidewall 40 of the main body 12. The second flue duct 38 may be disposed between the oven firebox 20 and a second sidewall 42 of the main body 12. In operation of the system 10, smoke and hot gases from a fire within the fireplace firebox 18 may be directed around the sides of the oven firebox 20. Heat transfer may also be minimized between the ducts 36, 38 and the oven firebox 20 through use of the insulating and refractory materials and the layered construction in forming the oven firebox 20, as described hereinabove.

Another embodiment of the system 110 is depicted in FIGS. 8-9. In FIGS. 8-9, like or related structure from FIGS. 1-7 and 10 are shown with the same reference number but in a 100-series for purpose of clarity.

The combination outdoor fireplace and pizza oven system 110 shown in FIGS. 8-9 has a single flue duct 136. The single flue duct 136 is disposed between the oven firebox 120 and a rear wall 144 of the main body 112. In operation, smoke and hot gases from a fire within the fireplace firebox 118 may be directed to the rear of the oven firebox 120. Heat transfer may also be minimized between the single flue duct 136 and the oven firebox 120 through use of insulating and refractory materials and the layered construction in forming the oven firebox 120, as described hereinabove.

It should be appreciated that the embodiment of the system 110 depicted in FIGS. 8-9 may permit for a construction with a narrower width, but greater depth, in comparison to the embodiment of the system 10 shown in FIGS. 1-7. Otherwise, the skilled artisan will understand that the systems 10, 110 may be operated in substantially the same manner, through a burning of fires in the respective fireboxes 18, 20, 118, 120.

With renewed reference to FIGS. 1-7, each of the fireplace firebox 18 and the oven firebox 20 has an opening 46, 48 at a front wall 50 of the main body. The opening 48 of the oven firebox 20 may be selectively closed by an oven door 52. The oven door 52 may be hingedly attached to the front wall 50 of the main body 12, for example. In certain examples, the oven door 52 is formed from stainless steel. The oven door 52 may have a grate that may be selectively opened and closed in order to control a supply of air to a fire burning within the oven firebox 18. The oven door 52 may be provided of other suitable materials and have other suitable configurations, as desired.

As shown in FIG. 7, the smokebox 22 is defined by an area above a dome 53 of the oven firebox 20 and a lower wall of the chimney flue 55. In particular embodiments, the dome 53 is formed by a plurality of interlocking bricks disposed in an arch. A vent 57 may be formed through an upper portion of the dome 53, and provides the communication between the interior of the oven firebox 20 and the smokebox 22. In operation, smoke and hot gases from the oven firebox 20 travel through the vent 57 and into the smokebox 22, where they collect and mix with the hot gases and smoke from the underlying fireplace firebox 18.

The smokebox 22 of the system is configured to collect smoke and hot gases from both the fireplace firebox 18 and the oven firebox 20. The smokebox 22 is also dimensioned to reduce an airspace cross-section to a choke-point 54, which transitions into the chimney flue 24. Advantageously, the reduced airspace cross-section of the smokebox 22 aides in creating a higher pressure above the choke-point 54 relative to a lower pressure within the fireplace firebox 18 in operation, so as to draw the smoke and the hot gases through the smokebox 22 and into the chimney flue 24, even when there is a crosswind in front of the open fireplace firebox 18.

Although not specifically shown, it should be understood that the chimney flue 24 may include a chimney damper or flap inside or at a top of the chimney flue 24, which can be adjusted manually to allow smoke to escape or air to enter. The chimney damper may be formed of metal or ceramic so as to tolerate the heat from the smoke and hot gases. The chimney damper may be opened and closed through a variety of suitable mechanisms, for example, a latch, a pull chain, or a handle, as desired.

In further embodiment, the system 10 may include a base 26. The base 26 is disposed beneath the fireplace firebox 18, and is configured to facilitate a transport of the combination outdoor fireplace and pizza oven system 10, for example, from a location of manufacture to an end user's location. The base 26 may include a pair of holes 56 formed in the front wall 50 of the base 26. Advantageously, the pair of holes 56 are configured to receive at least one of forklifts, slings, and straps for lifting and positioning the combination outdoor fireplace and pizza oven system 10.

In a particular example, the holes 56 may be defined by a pair of box-iron channels 58 connected to the framework assembly 14. In other examples, and the box-iron channels 58 may project outwardly from the main body 12 to define a step 60 of the combination outdoor fireplace and pizza oven system. Other suitable means of forming the holes 56 to securely and conveniently move the system 10 are also considered within the scope of the present disclosure.

Advantageously, the combination outdoor fireplace and pizza oven system 10, 110 facilitates the baking of edible goods such as pizzas in an outdoor environment, but may be constructed at a manufacturing facility offsite and easily transported to a final location for end use.

While certain representative embodiments and details have been shown for purposes of illustrating the invention, it will be apparent to those skilled in the art that various changes may be made without departing from the scope of the disclosure, which is further described in the following appended claims.

What is claimed is:

1. A combination outdoor fireplace and pizza oven system, comprising:

a main body including a framework assembly having a fireplace firebox, an oven firebox, a smokebox, and a chimney flue disposed therein, each of the fireplace firebox and the oven firebox in communication with the smokebox, and the smokebox in communication with the chimney flue, the framework assembly covered by a refractory heat resistant mortar, the main body further including a base disposed beneath the fireplace firebox and configured to facilitate a transport of the combination outdoor fireplace and pizza oven system, wherein the oven firebox is suspended above the fireplace firebox and configured for baking pizza, and the smokebox and the chimney flue are disposed in the framework assembly above both the fireplace firebox and the oven firebox, wherein the base includes a pair of holes formed in a front wall of the base, the pair of holes configured to receive at least one of forklifts, slings, and straps for lifting and positioning the combination outdoor fireplace and pizza oven system, and wherein the holes are defined by a pair of box-iron channels connected to the framework assembly and projecting outwardly from the main body to define a step of the combination outdoor fireplace and pizza oven system.

2. The combination outdoor fireplace and pizza oven system of claim 1, wherein the fireplace firebox is in communication with smokebox through at least one flue duct.

3. The combination outdoor fireplace and pizza oven system of claim 2, wherein the at least one flue duct includes a first flue duct and a second flue duct, the first flue duct disposed between the oven firebox and a first sidewall of the main body, and the second flue duct disposed between the oven firebox and a second sidewall of the main body.

4. The combination outdoor fireplace and pizza oven system of claim 2, wherein the at least one flue duct includes a single flue duct disposed between the oven firebox and a rear wall of the main body.

5. The combination outdoor fireplace and pizza oven system of claim 1, wherein the framework assembly includes a framework of steel channel members.

6. The combination outdoor fireplace and pizza oven system of claim 5, wherein the framework of steel channel members define chambers for the fireplace firebox and the oven firebox.

7. The combination outdoor fireplace and pizza oven system of claim 6, wherein each of the fireplace firebox and the oven firebox comprises noncombustible magnesium oxide board and refractory bricks.

8. The combination outdoor fireplace and pizza oven system of claim 7, further comprising mineral wool insulation disposed in the steel channel members between the magnesium oxide board of the fireplace firebox and the magnesium oxide board of the oven firebox.

9. The combination outdoor fireplace and pizza oven system of claim 1, wherein each of the fireplace firebox and the over firebox has an opening at a front wall of the main body.

10. The combination outdoor fireplace and pizza oven system of claim 9, wherein the opening of the oven firebox is selectively closed by an oven door hingedly attached to the front wall of the main body.

11. The combination outdoor fireplace and pizza oven system of claim 10, wherein the smokebox is configured to collect smoke and hot gases from both the fireplace firebox and the oven firebox and to reduce an airspace cross-section to a choke-point that transitions into the chimney flue.

12. The combination outdoor fireplace and pizza oven system of claim 11, wherein the reduced airspace cross-section of the smokebox aides in creating a higher pressure above the choke-point relative to a lower pressure within the fireplace firebox in operation to draw the smoke and the hot gases through the smokebox and into the chimney flue.

13. The combination outdoor fireplace and pizza oven system of claim 1, wherein the refractory heat resistant mortar includes fireclay, cement, and sand.

14. A combination outdoor fireplace and pizza oven system, comprising:

a main body including a framework assembly having a fireplace firebox, an oven firebox, a smokebox, and a chimney flue disposed therein, each of the fireplace firebox and the oven firebox in communication with the smokebox, and the smokebox in communication with the chimney flue, the framework assembly covered by a refractory heat resistant mortar, wherein the oven firebox is suspended above the fireplace firebox and configured for baking pizza, and the smokebox and the chimney flue are disposed in the framework assembly above both the fireplace firebox and the oven firebox, and wherein the smokebox is defined by an area above a dome of the oven firebox and a lower wall of the chimney flue.

15. The combination outdoor fireplace and pizza oven system of claim 14, wherein the dome is formed by a plurality of interlocking bricks disposed in an arch.

16. A combination outdoor fireplace and pizza oven system, comprising:

a main body including a framework assembly having a fireplace firebox, an oven firebox, a smokebox, and a chimney flue disposed therein, each of the fireplace firebox and the oven firebox in communication with the smokebox, and the smokebox in communication with the chimney flue, the framework assembly covered by a refractory heat resistant mortar, wherein the oven firebox is suspended above the fireplace firebox and configured for baking pizza, and the smokebox and the chimney flue are disposed in the framework assembly above both the fireplace firebox and the oven firebox, wherein the fireplace firebox is in communication with the smokebox via one of a first flue duct and a second flue duct, wherein the first flue duct is disposed between the oven firebox and a first sidewall of the main body and the second flue duct is disposed between the oven firebox and a second sidewall of the main body, and a single flue duct disposed between the oven firebox and a rear wall of the main body, and wherein the smoke box is defined by an area above a dome of the oven firebox and a lower wall of the chimney flue.

* * * * *